US009388017B1

(12) United States Patent
Wolf

(10) Patent No.: US 9,388,017 B1
(45) Date of Patent: Jul. 12, 2016

(54) ACCUMULATOR REEL FOR STRIP STEEL USED TO MANUFACTURE COILED TUBING

(71) Applicant: Clifton E. Wolf, Houston, TX (US)

(72) Inventor: Clifton E. Wolf, Houston, TX (US)

( * ) Notice: Subject to any disclaimer, the term of this patent is extended or adjusted under 35 U.S.C. 154(b) by 0 days.

(21) Appl. No.: 14/615,868

(22) Filed: Feb. 6, 2015

(51) Int. Cl.

| | |
|---|---|
| ***B65H 75/40*** | (2006.01) |
| ***B65H 49/38*** | (2006.01) |
| ***B65H 49/32*** | (2006.01) |
| ***B65H 54/40*** | (2006.01) |
| ***B21C 47/28*** | (2006.01) |

(52) U.S. Cl.
CPC ..... *B65H 49/38* (2013.01); *B21C 47/28* (2013.01); *B65H 49/32* (2013.01); *B65H 54/40* (2013.01)

(58) Field of Classification Search
CPC . B65H 75/40; B65H 75/403; B65H 2405/422
USPC ..... 242/390.7, 403, 557
See application file for complete search history.

(56) References Cited

U.S. PATENT DOCUMENTS

| | | | | |
|---|---|---|---|---|
| 2,691,819 | A | 10/1954 | Felton et al. | |
| 3,268,998 | A | 8/1966 | Urushiyama et al. | |
| 3,433,398 | A | 3/1969 | Fadden | |
| 3,698,223 | A | 10/1972 | Sagara | |
| 4,183,710 | A * | 1/1980 | Burdick | B60V 3/025 180/119 |
| 4,454,999 | A * | 6/1984 | Woodruff | B65H 49/34 242/388.7 |
| 4,709,872 | A * | 12/1987 | Hammer | B65H 23/063 242/421.6 |
| 5,365,856 | A * | 11/1994 | Richert | B21C 47/24 104/243 |
| 5,662,145 | A | 9/1997 | Stagg | |
| 5,934,604 | A * | 8/1999 | Klimek | B65H 16/06 242/557 |
| 6,007,014 | A | 12/1999 | Kruger | |
| 6,039,283 | A | 3/2000 | Munoz-Baca et al. | |
| 7,832,077 | B2 | 11/2010 | Crawford | |
| 2012/0048986 | A1 * | 3/2012 | Enwald | B65H 19/126 242/526 |

* cited by examiner

*Primary Examiner* — Sang Kim
(74) *Attorney, Agent, or Firm* — Egbert Law Offices, PLLC

(57) ABSTRACT

An accumulator apparatus for strip steel has a base, a frame extending upwardly from the base, a reel rotatably mounted to the frame and having a surface suitable for wrapping the strip steel therearound, and at least two wheels connected to the base and extending therebelow. The wheels are extendable such that the base is supported above an underlying surface and retracted such that the base is supported by the underlying surface. A motor is cooperative with each of the wheels so as to cause rotational movement thereof. A steering controller is cooperative with each of the wheels so as to control an angular direction of the wheel. An air brake is affixed to the frame and cooperative at the reel so as to stop or slow a rotation of the reel.

5 Claims, 5 Drawing Sheets

ACCUMULATOR REEL FOR STRIP STEEL USED TO MANUFACTURE COILED TUBING

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to apparatus for accumulating strip steel. More particularly, the present invention relates to accumulator apparatus for strip steel that are used in a preliminary step prior to the formation of coil tubing. The present invention also relates to apparatus for facilitating the movement of a strip steel accumulator apparatus between a strip steel receiving position and a strip steel dispensing position.

2. Description of Related Art Including Information Disclosed Under 37 CFR 1.97 and 37 CFR 1.98.

Coiled metal tubing has many applications in the petroleum industry. For example, coiled metal tubing can be used to inject high-pressure fluids into a well, to guide measuring instruments into a well, and in oil well drilling, production and flow line applications. Typically, the coiled metal tubing is stored on a large reel from which it can be uncoiled for insertion into the well and recoiled when the operation is complete.

Metal tubing is formed by bending a flat strip into a tubing and welding along the longitudinal seam. Because the length of strips commercially available is limited, the length of metal tubing which can be formed by this process is also limited.

Typically, a large amount of strip steel is placed on a reel. The strip steel can have a width of up to 15 feet and a length of approximately 500 feet. Ultimately, cutting operations are provided so as to cut the strip to a width which will correspond to the ultimate diameter of the coiled tubing produced from the strip. In order to accumulate the small width strips, a reel is provided upon which a length of the strip can be wrapped. Since the length of the strip will be approximately 500 feet, it is necessary to weld one end of one strip to the end of another strip and then wrap the combined strips around the wheel. Ultimately, this process is continued until a substantial length (e.g. 15,000 feet) is accumulated upon the reel.

After the strip steel is accumulated on to the reel, it is necessary move the reel from the receiving location to a dispensing location. The dispensing location will be in the nature of a seam welding apparatus and bending apparatus whereby the strip is bent so as to have a circular cross-section and then the seam is welded so as to form the coiled tubing. Ultimately, the coiled tubing is then wrapped around a spool for delivery to a well site.

Unfortunately, in the past, the great weight of the strip steel on the reel has made it exceedingly difficult to move the reel from the receiving location to the dispensing location. As such, a large number of persons are required so as to grasp the frame upon which the reel rotates and move the frame to the desired position. Under certain circumstances, up to twelve persons are required so as to effectively move the reel. This is not only time-consuming and expensive, it can also be somewhat dangerous to all the personnel involved in the movement of the reel.

So as to facilitate the movement of the reel, airbags have been deployed on the bottom of the base of the frame. These airbags dispense a stream of air therebelow such that the base can ride on a small cushion of air. Once again, it is extremely difficult to move and steer the reel and the frame to the desired location. The air cushion provides little are no directional control. As such, if movement is easy, then it becomes very difficult to stop the momentum created during this movement. Additionally, the momentum can also cause excessive turning. This could potentially result in the overturning of the frame and the reel. As such, need has developed so as to be able to properly move the frame and the reel from the receiving location to the dispensing location with a minimum involvement of personnel.

Additionally, during the dispensing of the strip steel, a great deal of inertia is created by the large amount of weight on the reel. As such, as the strip of steel is being dispensed, the momentum can cause the steel tube to flex and to undulate wildly. It is often necessary for the workers to manually control the rotation of the reel in order to prevent this problem from occurring. As such, a need has developed so as to be able to control the rotation of the reel during the dispensing of the strip steel in order to avoid these problems.

In the past, various patents have issued relating to the coiling and dispensing of strip steel. For example, U.S. Pat. No. 2,691,819, issued on Oct. 19, 1954 to Felton et al., describes the coiling of silicon steel strip. This method involves turning a partially formed coil of strip of previously bonded together sheets of silicon steel to continue formation of the coil, then successively bonding additional sheets of silicon steel to the trailing end of the strip while turning the coil so as to exert back tension on the strip between the trailing end of the strip and the coil and by the back tension alone causing the strip to form a straight even coil.

U.S. Pat. No. 3,268,998, issued on Aug. 30, 1966 to the Urushiyama et al., discloses a method for forming a sheet strip into a loose coil. This method includes the steps of placing a flammable material on the strip, rolling the strip of steel into a coil with the flammable material between the spires of the coil and spacing the spires of the coil. The coil is heated to burn away the flammable material completely so as to leave a space between the spires of the coil.

U.S. Pat. No. 3,433,398, issued on Mar. 18, 1969 to Fadden, shows a magnetic bridal in the unit for winding steel strip. The apparatus utilizes a bridal unit having an electromagnetic roll about which the single strip or multiplicity of strands pass prior to coiling on a take-up reel. The adjustable magnetic force of the bridal unit is sufficient to control and maintain a predetermined tension in each of the strands being wound on the take-up reel.

U.S. Pat. No. 3,698,223, issued Oct. 17, 1970 to H. Sagara, describes an apparatus for spirally winding strip metal. This apparatus comprises a pressure roll for urging the strip metal into a coil. Feed rolls serve to feed the strip material to the pressure roll and combined with the pressure roll to increase the radius of the strip material immediately preceding its application to the coil. A means is provided for supporting the coil as it is wound and for maintaining the coil in contact with the pressure roll.

U.S. Pat. No. 5,662,143, issued on Sep. 2, 1997 to R. E. Stagg, shows a dual bias weld for continuous coiled tubing. Tubing is first formed from a first strip and a second strip. The first and second strips are of the same width. A planar end surface is formed on an end of this first strip. Similarly, a planar end surface is formed on an end of a second strip. The composite strip is formed by welding the planar end surface of the first strip to the planar end surface of the second strip so as to form a dual bias weld. Coiled metal tubing is then formed from the composite strip.

U.S. Pat. No. 6,007,014, issued on Dec. 28, 1999 to J. Kruger, describes a winding machine for the production of at least one coil of supplied material web. The material web is guided through a longitudinal cutting device and the partial webs of the longitudinally cut material web are each wound up into a core. A coil arising on the core is supported by at least one support roll. A web tension interruption device is provided in the running direction of the web directly in front of a portion where the supplied material web run into the associated support roll. At least one roll is spatially separate from the associated support roll.

U.S. Pat. No. 6,039,283, issued on Mar. 21, 2002 to Munoz-Baca et al., teaches a thin strip coiling system. The system includes a flap guide positionable in at least two positions. The first position contacts a pinch roll during the initial threading portion of each strip to be coiled and a second normal operating position without contact with the pinch roll when the strip is being wound in the predetermined coiler.

U.S. Pat. No. 7,832,077, issued on Nov. 16, 2010 to J. Crawford, shows a method of manufacturing a coiled tube system which involves introducing a first continuous length of coiled tubing onto a surface of a continuous length of flat material, arranging the first coiled tubing such that the longitudinal axis of the first coiled tubing is parallel to the sides of the flat material, fixing the first coiled tubing along the length of the surface of the flat metal, and forming the flat metal into a second continuous length of coiled tubing that contains the first coiled tubing.

It is an object of the present invention to provide an accumulator apparatus which effectively allows for the accumulation of strip steel thereon.

It is another object of the present invention to provide an accumulator apparatus that can be easily moved.

It a further object of the present invention to provide an accumulator apparatus which can be manipulated and moved by a minimum number of personnel.

It is another object of the present invention to provide an accumulator apparatus in which the accumulator apparatus can be easily moved from a receiving location to a dispensing location.

It is still further object the present invention to provide an accumulator apparatus which avoids the problems associated with momentum of the frame or with inertia of the reel during the dispensing of the strip steel.

It is a further object of the present invention to provide an accumulator apparatus which enhances the safety to personnel involved in the use in the use of the accumulator apparatus.

It is still a further object of the present invention to provide an accumulator apparatus which is easy-to-use, easy to manufacture and relatively inexpensive.

These and other objects and advantages of the present invention will become apparent from a reading of the attached specification and appended claims.

BRIEF SUMMARY OF THE INVENTION

The present invention is a an accumulator apparatus for strip steel which comprises a base, a frame extending upwardly from the base, a reel rotatably mounted to the frame, and at least two wheels connected to the base and extending therebelow. The reel has a surface suitable for wrapping the strip steel therearound. The wheels are extendable such that the base is supported above an underlying surface and retracted such that the base is supported by the underlying surface.

In the present invention, a plurality of airbags are connected to the base and extend therebelow. The plurality of airbags are suitable for directing an air flow toward the underlying surface. The wheel has a surface at a level below a level of the bottom surface of the airbag when the wheel is in the extended position.

A motor is cooperative with each of the wheels. The motor is suitable for causing rotational movement of the wheel. A steering controller is also cooperative with each of the wheels so as to control an angular direction of the wheel.

In the present invention, a housing is affixed to the base. The wheel has an axle supported by the housing. The motor has a shaft with a gear affixed thereto. The axle has a sprocket affixed thereto. The gear is meshed with or cooperatively meshed with the sprocket such that a rotation of the shaft of the motor causes a corresponding rotation of the wheel. A tire is supported by each of the wheels.

The at least two wheels includes at least four wheels connected at different locations to the base. A first pair of wheels are positioned in spaced relation to each other at a forward portion of the base and a second pair of wheels are positioned in spaced relation at a rearward portion of the base. The steering controller is cooperative with at least one of the first and second pairs of wheels such that the pair of wheels are directed in correspondence with each other. The motor includes a pair of motors that are cooperative with at least one of the first and second pairs of wheels such that each wheel of the pair of wheels rotates with a common rotational velocity.

An air brake is affixed to the frame and is cooperative with the reel so as to stop or slow a rotation of the reel.

This foregoing Section is intended to describe, with particularity, the preferred embodiment of the present invention. It is understood that modifications to this preferred embodiment can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1:
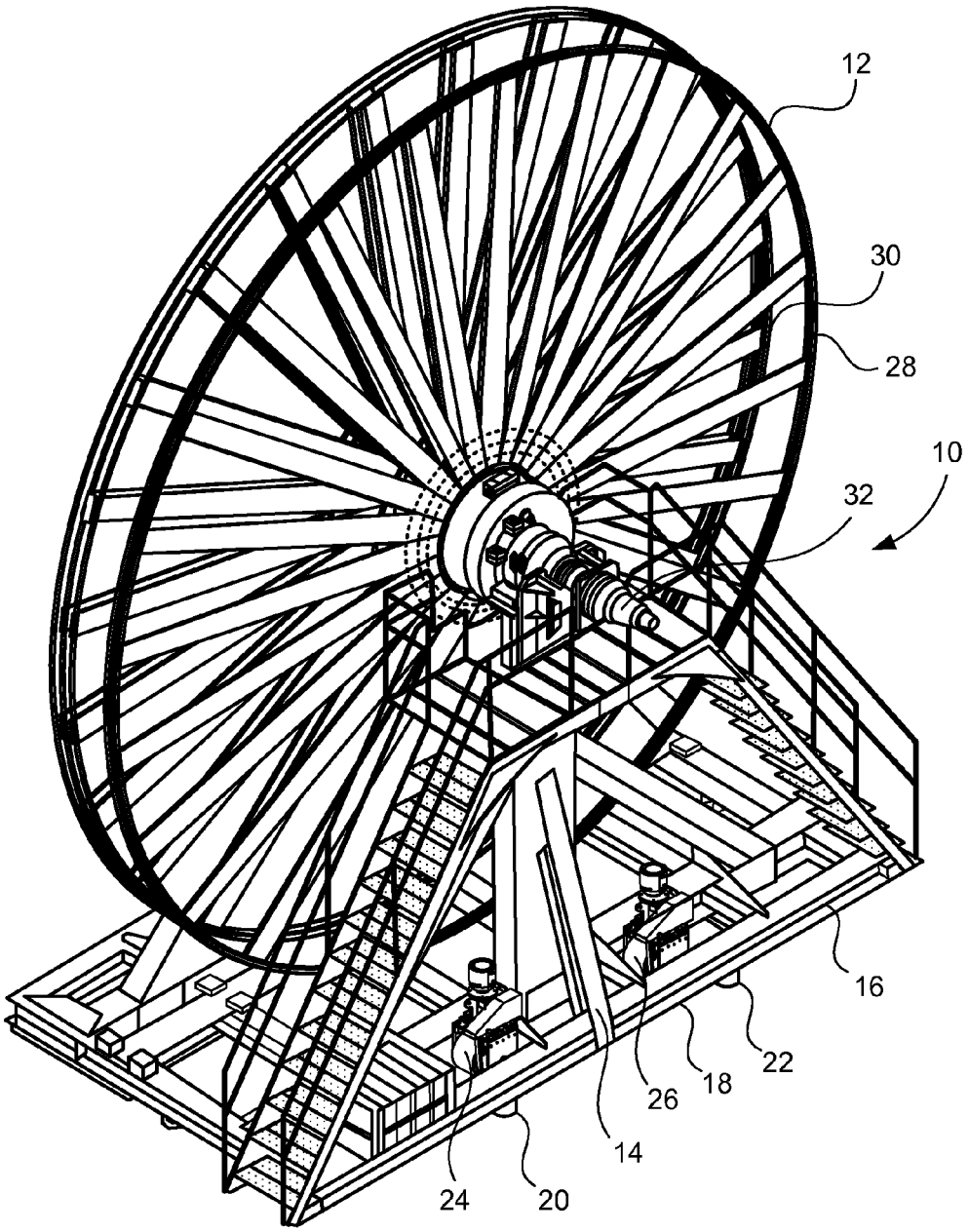
FIG. 1 is a perspective view showing the accumulator apparatus of the present invention.

Referring to FIG. 1, there is shown the accumulator apparatus 10 of the present invention. The accumulator apparatus 10 includes a reel 12 that is rotatably mounted to a frame 14. The frame 14 extends upwardly from a base 16. The base 16 has a bottom surface 18. A plurality of airbags 20 and 22 are illustrated as extending downwardly from the base 16. Importantly, in the present invention, there is at least a pair of wheels 24 and 26 that is affixed to the base 16 such that each of the wheels 24 and 26 can extend downwardly below the bottom surface 18 the base 16.

In normal use, the strip steel will be wrapped around the reel 12. As the strip steel is delivered to the reel 12, the reel 12 will rotate such that an accumulation of the strip steel will be received between the sides 28 and 30 thereof. The frame 24 includes several structural members that are affixed to the base 16 and extend upwardly therefrom. Ultimately, the frame 24 will serve to rotatably support an axle 32. As such, as the frame 14 remains in a fixed position, the reel 12 is free to rotate.

In normal use, when the reel 12 is utilized so as to receive strip steel thereon, the airbags 20 and 22 (along with the other airbags) will be generally deflated such that the bottom surface 18 of the base 16 will reside upon the underlying surface. As such, a solid support for the reel 12 is created by the relationship between the base 16 on the underlying surface. When it is desired to move the accumulator apparatus 10 from the receiving position to the dispensing position, the airbags 20 and 22 would be inflated and a small but forceful stream of air is delivered downwardly toward the underlying surface. This will create an air cushion so as to facilitate the movement of the accumulator apparatus from the receiving position to the dispensing position.

Figure 2:
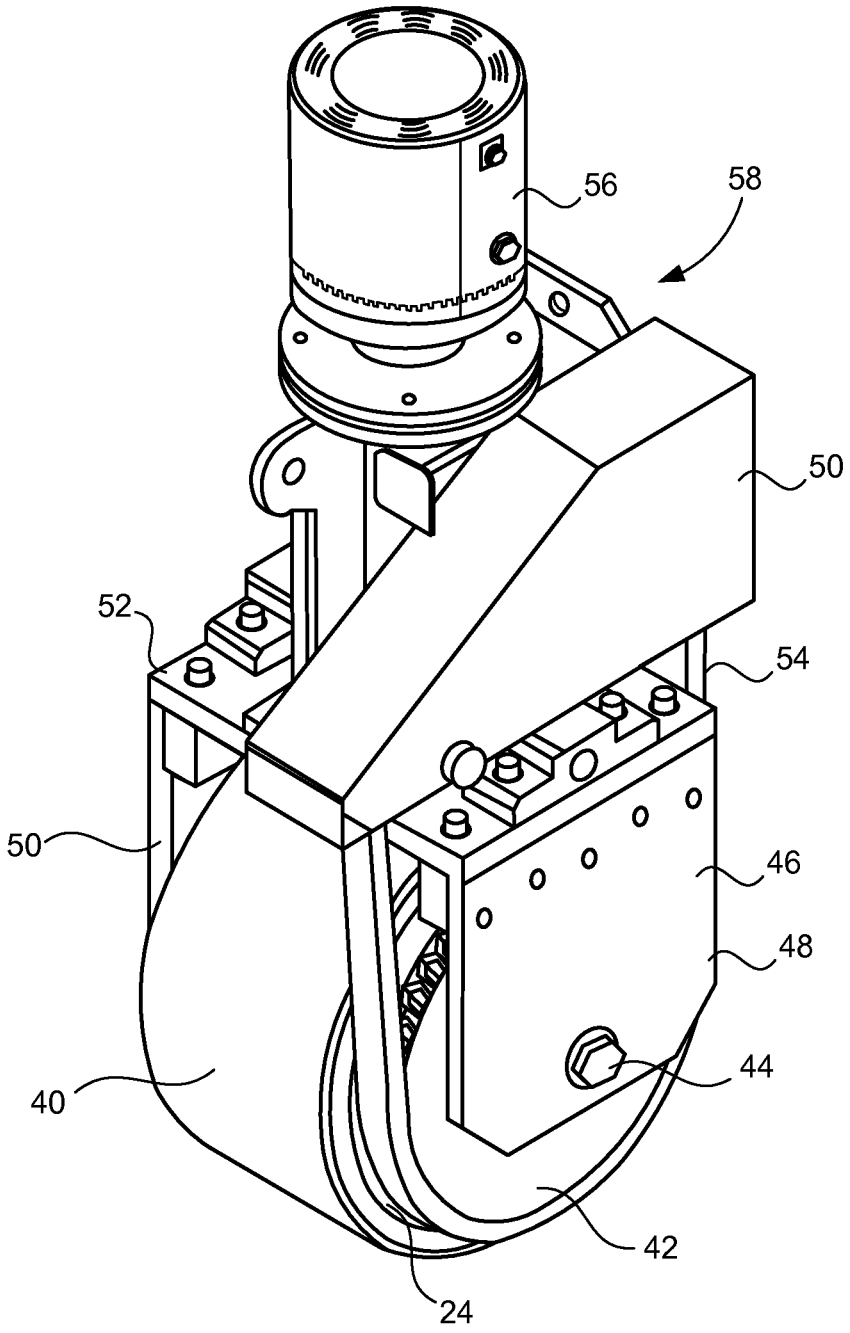
FIG. 2 is a perspective view showing the wheel associated with the accumulator apparatus of the present invention.

FIG. 2 shows the wheel 24. Wheel 26 (along with other wheels) will have a similar configuration to that of wheel 24. With reference to FIG. 1, the wheels can be pulled positioned in spaced relationship to each other at a forward portion of the base 16 and another pair of wheels, such as wheels 24, can be positioned adjacent to a rearward portion of the base 16. The pair of wheels that the forward portion of the base 16 can be controlled in coordination with each other. Also, if desired, the pair of wheels located at the rearward portion of the base 16 can also be controlled in relation to each other.

In FIG. 2, it can be seen that the wheel 24 has a tire 40 extending thereover. The tire 40 will have a suitable configuration so as to contact the underlying surface. The wheel 24 includes a sprocket 42 mounted upon an axle 44. The axle 44 is supported by a housing 46. Housing 46 will include a first plate 48 extending on one side of the wheel 24 and another plate 50 extending across an opposite side of the wheel 24. The plates 48 and 50 will be connected by a cross structure 52. The plates 48 and 50 will reside in generally parallel planar relationship to each other. The sprocket 42 resides between the side of the wheel 24 and the plate 48 of housing 46. A motor shroud 50 is located above the wheel 24. As such, a motor will reside within the interior of the shroud 50. A belt 54 extends from the motor within the shroud 52 downwardly so as to connect with the sprocket 42 associated with the wheel 24. An actuator 56 is located at the top of the wheel assembly 58. Actuator 56 is in the nature of a piston-and-cylinder arrangement. The actuator 56 can cause the wheel 24 to move upwardly or downwardly. As such, actuator 56 is suitable for allowing the wheel 42 to move between its retracted position and its extended position. A steering controller can be included within the housing 46 or within the shroud 54 so as to control an angular orientation of the housing 46. As such, this facilitates the ability to rotate the housing 46, along with the wheel 24, so as to achieve proper steering of the wheel 24. The housing 46 also includes suitable connectors thereon so as to allow the wheel 24 to be connected to the base 16 of the accumulator apparatus 10.

Figure 3:
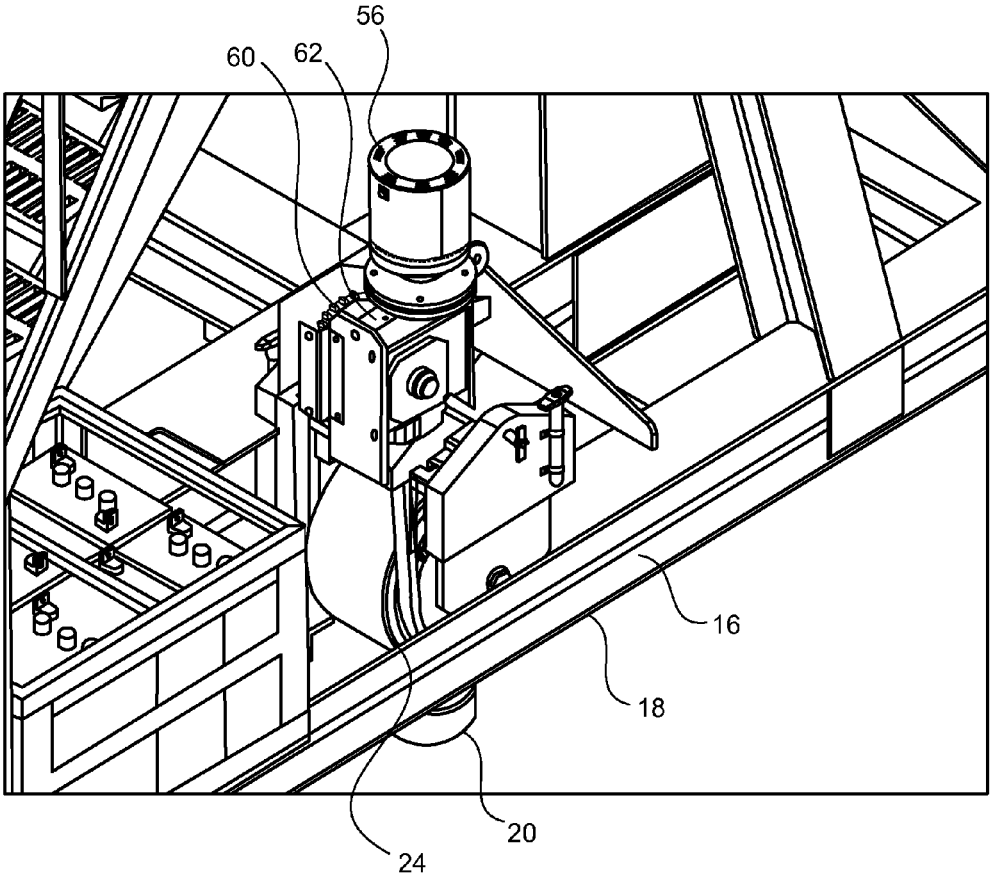
FIG. 3 is a perspective view showing the mounting of the wheel relative to the base and relative to the airbag.

FIG. 3 shows the wheel 24 as affixed to the base 16. In particular, it can be seen that the wheel 24 is located on the inner side of the structural beam of the base 16. The airbag 20 is affixed to the bottom surface 18 of the base 16. FIG. 3 also shows that there is a gear 60 that is connected to the motor 62. Motor 62 will have a shaft extending outwardly therefrom. This gear 60 is connected to the shaft of the motor. As such, when the shaft rotates, the gear 60 will rotate. Gear 60 can be meshed with the belt 54 or with the sprocket 42 so as to allow for the rotation of the wheel 24. The actuator 56 will be positioned above the base 16.

Figure 4:
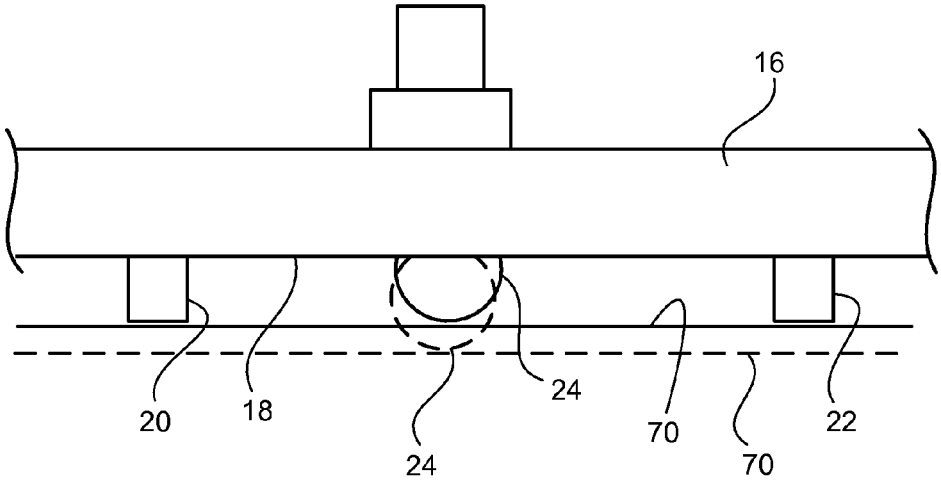
FIG. 4 is a side elevational view showing the wheels as extending between its retracted position and its extended position.

FIG. 4 illustrates diagrammatically how the wheel 24 is movable between its retracted position (illustrated in solid lines) and its extended position (illustrated in broken lines). Also, it can be seen how the wheel 24 is located between the airbags 20 and 22. In normal use, in the retracted position, the base 16 is directly residing upon the underlying surface 70. The airbags 20 and 22 (or feet) can support the base 16 upon the underlying surface 70. In other embodiments, the bottom 18 of the base 16 will reside directly on the underlying surface 70. Under this circumstance, the wheel 24 will be retracted upwardly so that it resides entirely within the width of the thickness or width of the base 16.

In the extended position, the wheel 24 (illustrated in broken) will be supporting the base 16 upon the underlying surface 70 (illustrated in broken line). As such, the bottom surface 18 of the base 16 will rise a distance above the underlying surface 70 (illustrated in broken lines). The contact between the wheel 24 and the underlying surface 70 facilitates the ability to move the base 16 (along with the frame 14 and the reel 12) upon the underlying surface.

Figure 5:
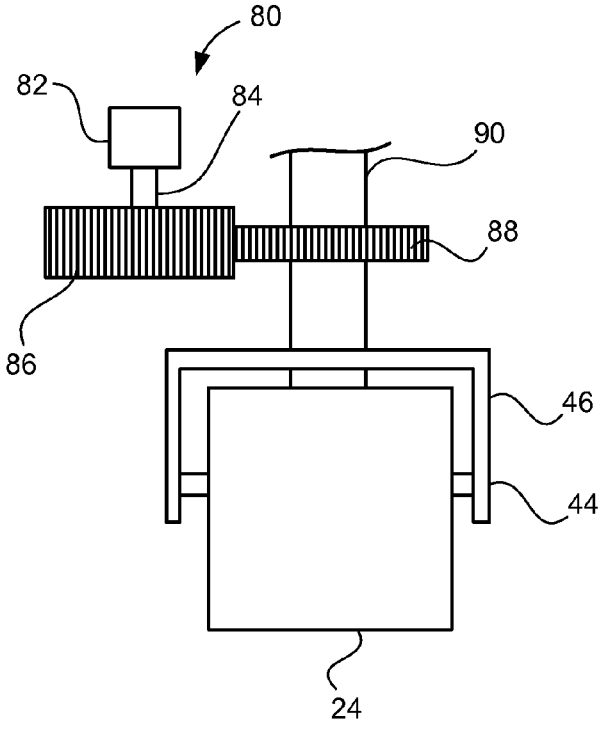
FIG. 5 is a view showing an illustration showing the steering controller associated with the wheel of the accumulator apparatus the present invention.

FIG. 5 illustrates the steering control mechanism 80 of the present invention. In particular, it can be seen that there is a small motor 82 that is connected by a shaft 84 to a gear 86. Gear 86 is meshed with a sprocket 88 affixed to the rod 90 extending from the actuator 56. The rod 90 is connected to the housing 46 of wheel 24. The axle 44 extends so as to be supported by the housing 46. When the gear 86 is rotated by the motor 82, this can cause the sprocket 88 on the rod 90 to rotate so as to correspondingly rotate the housing 46 in the associated wheel 24. As such, the present invention is able to achieve proper steering.

Within the concept of the present invention, the motor 60, the steering control mechanism 80 and the actuator 56 can be connected to a suitable processor. As such, wired or wireless control of these components can be achieved. Ultimately, a remote control, including a joystick, can be utilized so as to control the orientation of the wheels along with the angular direction of the wheels. The remote control can also allow for the extension or retraction of the wheels. The remote control can also control the rotational velocity of the wheels.

Figure 6:
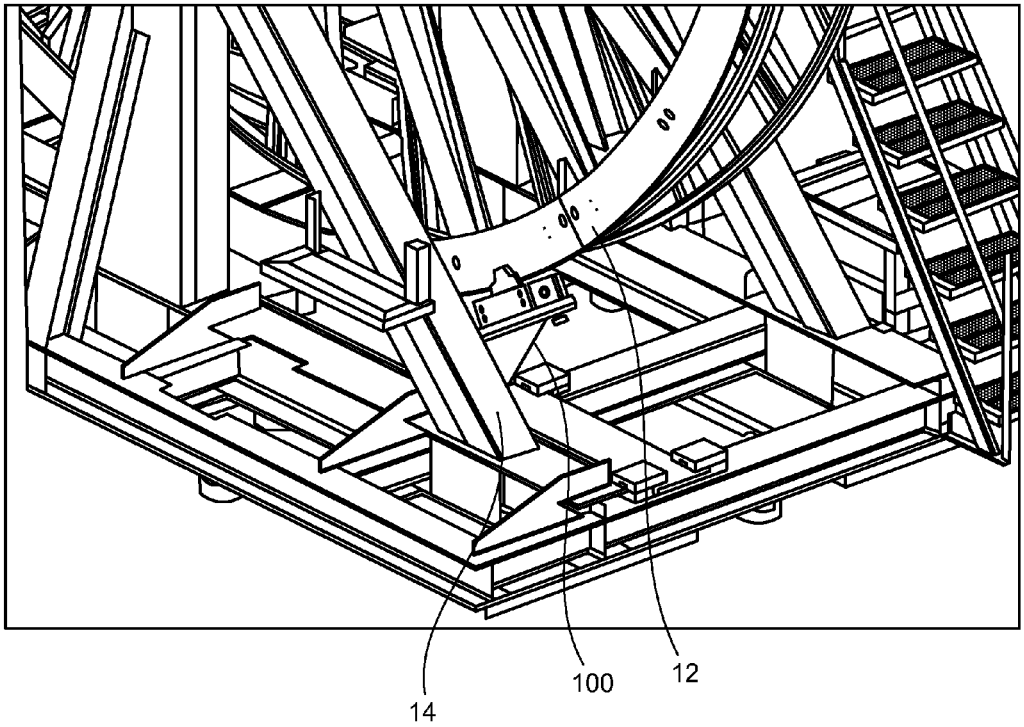
FIG. 6 is a perspective view showing the air brake as applied to the reel of the accumulator apparatus of the present invention.

FIG. 6 illustrates an air brake 100 that is affixed to the frame 14 and cooperative with the reel 12. The air brake 100 can be connected to a supply of pneumatic pressure. The air brake 100 can be actuated such that the calipers associated with the air brake 100 will bear against the sides of the reel 12 so as to stop or slow the rotation of the reel 12. When the air brake 100 is actuated, the calipers will engage the reel 12 so as to stop or slow the reel 12. As a result, any problems associated with the inertia of the reel 12 during the dispensing of the strip steel can be avoided. The air brake 100 can be applied whenever and excessive rotational forces achieved or when the strip steel starts to undulate. As such, the air brake 100 is able to achieve a more efficient dispensing of the strip steel from the reel 12.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. An accumulator apparatus for strip steel, the accumulator apparatus comprising:

a base;

a frame extending upwardly from said base;

a reel rotatably mounted to said frame, said reel having a surface adapted to wrap the strip steel therearound; and a pair of air bags connected to one side of said base in spaced relation to each other, said pair of airbags adapted to direct an air flow toward the underlying surface;

at least two wheels connected to said base and extending therebelow, the wheels being extendable such that said base is supported above an underlying surface and retracted such that said base is supported by said underlying surface, said at least two wheels positioned between said pair of airbags, said at least two wheels having a surface at a level below a level of a bottom surface of said pair of airbags when in the extended position; and a pair of motors cooperative respectively with the wheels such that the wheels rotate with a common rotational velocity.

2. The accumulator apparatus of claim 1, further comprising:

a tire supported by each of the wheels.

3. The accumulator apparatus of claim 1, said at least two wheels comprising:

at least four wheels connected at different locations to said base.

4. The accumulator apparatus of claim 3, said at least four wheels comprising:

a first pair of wheels positioned in spaced relation to each other at a forward portion of said base; and a second pair wheels positioned in spaced relation at a rearward portion of said base.

5. The accumulator apparatus of claim 1, further comprising:

an air brake affixed to said frame and cooperative with said reel so as to stop or slow a rotation of the reel.

* * * * *